US008267243B2

(12) United States Patent
Ambroise et al.

(10) Patent No.: US 8,267,243 B2
(45) Date of Patent: Sep. 18, 2012

(54) POSTAL SORTING MACHINE WITH A MANUAL FEED STATION

(75) Inventors: Stephane Ambroise, Tain l'Hermitage (FR); Mathieu Bayon, Valence (FR); Bernard Constant, Beaumont les Valence (FR)

(73) Assignee: Solystic, Gentilly Cedex (FR)

( * ) Notice: Subject to any disclaimer, the term of this patent is extended or adjusted under 35 U.S.C. 154(b) by 377 days.

(21) Appl. No.: 12/677,455

(22) PCT Filed: Dec. 8, 2009

(86) PCT No.: PCT/FR2009/052440

§ 371 (c)(1),
(2), (4) Date: Mar. 10, 2010

(87) PCT Pub. No.: WO2010/072937

PCT Pub. Date: Jul. 1, 2010

(65) Prior Publication Data

US 2011/0186404 A1 Aug. 4, 2011

(30) Foreign Application Priority Data

Dec. 23, 2008 (FR) ..... 08 59047

(51) Int. Cl.
*B65H 5/38* (2006.01)

(52) U.S. Cl. ..... 198/860.4; 198/348; 271/2; 271/9.13

(58) Field of Classification Search ..... 198/860.4, 198/348, 357; 271/2, 9.13; 209/900
See application file for complete search history.

(56) References Cited

U.S. PATENT DOCUMENTS

| | | | | |
|---|---|---|---|---|
| 5,421,699 | A * | 6/1995 | Guiles et al. | 414/788 |
| 5,617,804 | A * | 4/1997 | Savio | 112/304 |
| 5,954,330 | A * | 9/1999 | Rabindran et al. | 271/270 |
| 6,435,331 | B1 * | 8/2002 | Olson et al. | 198/357 |
| 7,647,684 | B2 * | 1/2010 | Redford et al. | 29/426.4 |

FOREIGN PATENT DOCUMENTS

WO 98/24719 A 6/1998

* cited by examiner

*Primary Examiner* — Mark A Deuble
(74) *Attorney, Agent, or Firm* — Sughrue Mion, PLLC

(57) ABSTRACT

A postal sorting machine comprising an automatic feed station (8) with an unstacker device (2), a manual feed station (9), and a sorting conveyor adapted to move mailpieces in series one behind another in a conveying direction (31), the automatic feed station being designed to feed the conveyor automatically with mailpieces from a stack of mailpieces, the manual feed station (9) being adapted to receive mailpieces inserted individually and to place them in the conveyor. The manual feed station (9) comprises a protective cover forming a sort of tunnel over the conveyor, and an insertion slot (26) provided in the protective cover and through which a mailpiece can be inserted into the tunnel, said slot being in vertical alignment with a mailpiece receiving and handling space (34) for receiving and handling a mailpiece in the conveyor, which space is funnel-shaped.

5 Claims, 2 Drawing Sheets

POSTAL SORTING MACHINE WITH A MANUAL FEED STATION

The invention relates to a postal sorting machine comprising an automatic feed station with an unstacker device, a manual feed station, and a sorting conveyor adapted to move mailpieces in series one behind another in a conveying direction. The automatic feed station is designed to feed the conveyor automatically with mailpieces from a stack of mailpieces. The manual feed station is adapted to receive mailpieces inserted manually and individually, and to place them in the conveyor.

Such a manual feed station makes it possible, before, during, or after the flow of the mailpieces automatically unstacked at the inlet of the machine, to insert other mailpieces that are unsuitable for machine-unstacking or that are non-standard. Such non-standard mailpieces are mailpieces that, for example, are of size that is too large, of thickness that varies, or of weight that is too large for them to be handled by an automatic unstacker. Such mailpieces can also be letters surrounded by adhesive tape or by string.

Patent Document U.S. Pat. No. 5,954,330 discloses such a machine in which the sorting conveyor moves the mailpieces on edge and the manual feed station is in the form of another conveyor for conveying mailpieces on edge that converges towards the sorting conveyor. That solution suffers from the drawback of occupying a non-negligible floor area and can require additional apparatus to be put into place for enabling the flows of mailpieces to converge, such additional apparatus increasing the cost of the sorting machine.

An object of the invention is thus to propose a sorting machine with a manual feed station for mailpieces unsuitable for machine-unstacking or non-standard that does not suffer from the above drawbacks.

To this end, the invention provides a postal sorting machine comprising an automatic feed station with an unstacker device, a manual feed station, and a sorting conveyor adapted to move mailpieces in series one behind another in a conveying direction, the automatic feed station being designed to feed the conveyor automatically with mailpieces from a stack of mailpieces, the manual feed station being adapted to receive mailpieces inserted individually and to place them in the conveyor, said postal sorting machine being characterized in that the manual feed station comprises a protective cover forming a sort of tunnel over the conveyor, and an insertion slot provided in the protective cover and through which a mailpiece can be inserted into the tunnel, said slot being in vertical alignment with a mailpiece receiving and handling space for receiving and handling a mailpiece in the conveyor, which space is funnel-shaped.

It can thus be understood that the basic idea of the invention is to form a mailpiece insertion slot in the protective cover in the manner of a letterbox slot, with dimensions adapted to receiving a mailpiece unsuitable for machine-unstacking that is inserted into the slot in a widthwise on-edge position. Said insertion slot may also be designed to guide the inserted mailpiece vertically so that it stays in this position until it reaches the mailpiece-receiving space. For this purpose, it is possible to make provision for the edges of the insertion slot to define a sort of vertical channel. For example, said channel may be formed by folding over the edge of the sheet metal of which the cover is made to form a downwardly extending rim over the periphery of the slot.

In an embodiment of the invention, said funnel-shaped space has a bottom defined by a horizontal bed onto which the mailpiece inserted into the slot falls on edge, and sides defined by two conveying surfaces that extend relative to each other so as to converge in the conveying direction.

The conveying surfaces of said mailpiece receiving and handling space that forms a sort of funnel (inverted pyramid) may be constituted by two opposite belts mounted on pulleys, one of the two belts being engaged, in the zone of convergence with the other belt, over a pulley having an axle that is mounted to move relative to the bed and that is inclined relative to the vertical, so that said two belts can nip mailpieces of different thicknesses or mailpieces of varying thickness. By way of example, the inclination of the moving axle of said pulley may be about 20° while the mailpiece-receiving bed may extend over a length of about 400 millimeters (mm), it being possible for the V-shape defined on the bed by said two belts to have an angle of about 30° . Said space for receiving and handling mailpieces that are inserted manually may be interposed between the unstacker device and an image acquisition device serving to read postal addresses, and thus its presence does not increase the floor area or "footprint" occupied by the sorting machine. As can be understood, it may, in practice, be an integral part of the on-edge conveyor of the unstacker. Said manual feed station may advantageously be part of a mailpiece-tilting station for tilting large-format mailpieces or "flats" if the sorting machine is more specially adapted to this category of mailpiece. It is known that, for this category of mailpiece, it can be necessary to tilt each mailpiece before it goes go through the image-forming system from an on-edge vertical position to an inclined position in which it is inclined relative to the vertical or to a flat position in order to avoid them flopping.

The invention can be understood more clearly on reading the following description with reference to the drawings. This description is given merely by way of indication and is in no way limiting on the invention.

Figure 1:
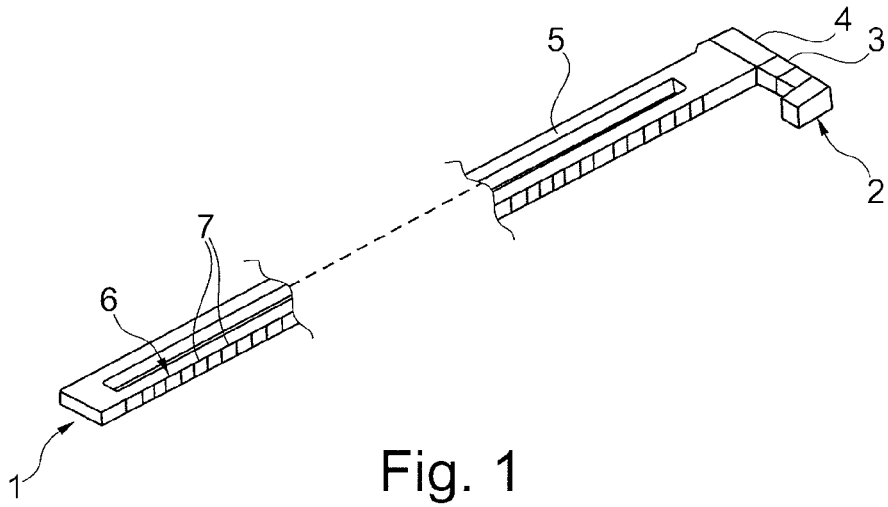
FIG. 1 is a diagrammatic fragmentary perspective view of a postal sorting machine of the invention.

FIG. 1 shows a sorting machine 1 of the invention conventionally equipped with a feed inlet having an unstacker device 2 that feeds a sorting conveyor 3 in which the unstacked mailpieces are moved in series one behind another. Said conveyor 3 has a conveyor portion that is, in this example, interposed between the unstacker proper 2 and an image acquisition system 4 for automatically reading postal addresses from the surfaces of the mailpieces with a view to directing the mailpieces towards sorting outlets. In FIG. 1, downstream from the system 4, a carrousel 5 having bins 6 is shown that serves to direct flats towards sorting outlets 7.

Figure 2:
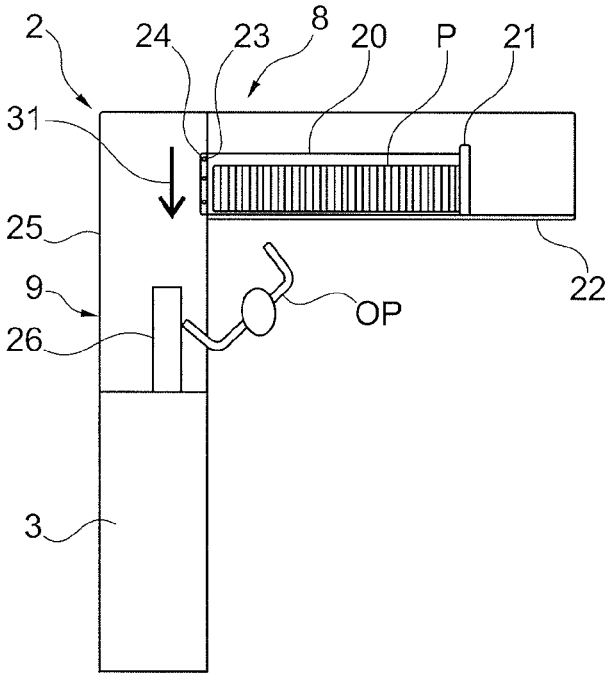
FIG. 2 is a view from above of the unstacker device.

FIG. 2 is a more detailed view showing the inlet of the sorting machine 1, and in particular the automatic feed station 8 with the unstacker 2, and the manual feed station 9 that is an integral part of the unstacker device 2.

The automatic feed station 8 conventionally comprises a conveyor belt 20 that moves with a paddle 21 along a jogging wall 22 to bring a stack of mailpieces P towards a vertical unstacking face 23 that is perpendicular to the direction in which the stack of mailpieces moves. Perforated strips 24 are also shown that, in co-operation with suction nozzles, separate the first mailpiece of the stack and direct it in the feed direction indicated by arrow 31.

The manual feed station 9 includes a cover 25 forming a sort of tunnel over the conveyor situated downstream from the unstacking face 23 and in which the mailpieces in series are moved in a certain conveying direction (corresponding in this example to the direction indicated by arrow 31). In the top of the cover 25, an elongate slot 26 is shown that extends in the conveying direction 31 and that serves for manual insertion of mailpieces that are unsuitable for machine-unstacking. Said slot is aligned vertically with a mailpiece-receiving space in the conveyor so that a mailpiece that is inserted on edge into the slot can fall by gravity directly into the mailpiece-receiving space in order to be conveyed in a conveying direction in series with a flow of mailpieces coming from the automatic unstacker station 8.

The operator, indicated by reference OP, and positioned as shown in FIG. 2 is thus as close as possible to the automatic and to the manual feed stations so that said operator can go from one to the other while also minimizing such movements.

Figure 3:
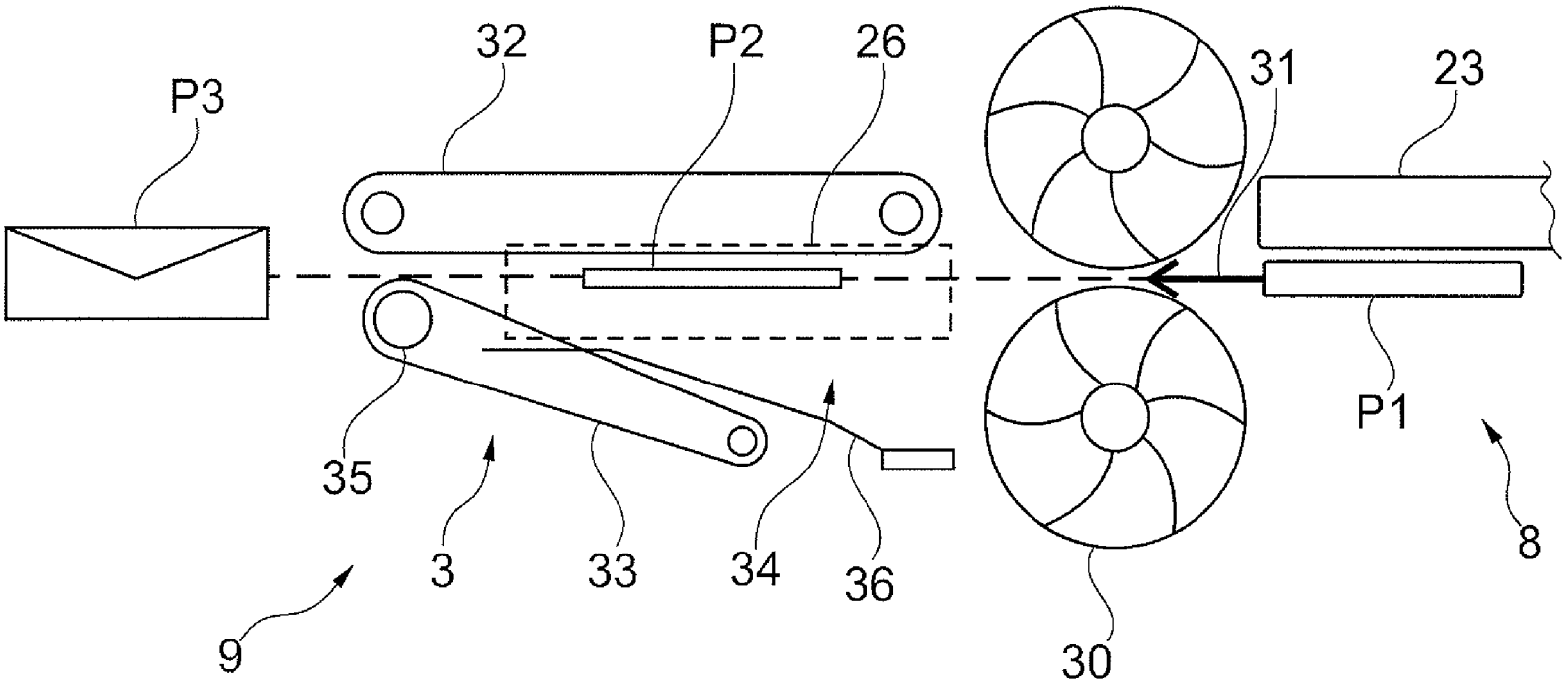
FIG. 3 is a view from above of the manual insertion zone.

FIG. 3 shows in detail the space for receiving and handling a mailpiece coming from the insertion slot 26. In this example, this space is situated downstream from two opposite "low-pressure" motor-driven wheels 30 that are disposed at the outlet of the unstacking face 23 of the automatic unstacking station 8. These two wheels 30 thus come to nip each mailpiece that is unstacked so as to move it in the conveying direction indicted by arrow 31. P1 designates a mailpiece on edge, in the vertical position, and coming from the unstacker, and that is reaching the nip point at which it is nipped between the two motor-driven wheels 30.

In FIG. 3, this mailpiece-receiving space of the manual feed station of the invention is indicated by reference 34, and is an integral part of the on-edge conveyor of the unstacker. In this zone, a mailpiece P2 that is coming from the slot 26 (indicated in dashed lines) situated vertically in register with the mailpiece-receiving space 34 is handled on edge and in the vertical position. At the outlet of said space 34, the mailpiece P3 is moved by the conveyor on edge but in an inclined position. It can thus be understood that said space 34 can be part of a mailpiece-tilting station.

In the invention, this mailpiece receiving and handling space 34 of the manual feed station is funnel-shaped.

In particular, the bottom of the funnel is defined by a horizontal bed (not shown) onto which the mailpiece inserted into the slot 26 falls. The sides of the funnel are defined by two conveyor surfaces of the conveyor that face each other so as to converge towards each other in the horizontal plane at the outlet of said space, as can be seen in FIG. 3. The two surfaces can also be inclined relative to each other so as to converge towards each other in the vertical direction.

In FIG. 3 the two conveyor surfaces are shown by two opposite belts (or strips) 32 and 33 engaged over pulleys or wheels such as 35. In this example, the first belt 32 extends parallel to the conveying direction 31 whereas the second belt 33 extends at an angle relative to said direction 31 so as to define a second mailpiece nip point that is situated on the downstream side of the mailpiece-receiving space 34 for receiving the manually inserted mailpieces.

In addition, in the example shown in FIG. 3, the pulley 35 disposed at the nip point of the belts 32 and 33 and over which the belt 33 is engaged is a pulley having its axle mounted to move in the plane of the horizontal bed, and said axle is also mounted in a manner such as to be inclined relative to said bed, thereby imparting to the belt 33 an inclination in the vertical direction so as to define the funnel-shape for the space 34. The angle of inclination of the axle of the pulley 35 may, for example, be about 20 degrees.

The reference 36 designates a rigid guide that pushes the tops of the mailpieces towards the belt 32 as they arrive in the space 34.

Naturally, it is also possible to make provision for the strip 32 to be inclined symmetrically to the belt 33, without going being the ambit of the invention.

Since the pulley 35 is mounted to move in the plane of the bed of the conveyor, it can move out of the way in order to handle mailpieces of different thicknesses (a standard mailpiece sent by the unstacker 2 followed by a mailpiece unsuitable for machine-unstacking inserted into the slot 26) or mailpieces of varying thickness.

Alternatively to what is described above, the flow of the mailpieces unsuitable for machine-unstacking coming from the insertion slot can be separated from the flow of mailpieces coming from the automatic feed station. In which case, all of the mailpieces coming from the automatic feed station are processed before or after the mailpieces unsuitable for machine-unstacking are inserted manually. Preferably, each sorting outlet is then equipped with two racks for receiving the mailpieces from the bin carrousel. At the end of the sorting pass, the mailpieces directed towards a sorting outlet are received in one or the other of the racks depending on whether they come from the automatic feed station or from the manual insertion slot, thereby facilitating subsequent mixing of the mailpieces for the purpose of forming the delivery round.

The invention claimed is:

1. A postal sorting machine (1) comprising an automatic feed station (8) with an unstacker device (2), a manual feed station (9), and a sorting conveyor (3) adapted to move mailpieces in series one behind another in a conveying direction (31), the automatic feed station (8) being designed to feed the conveyor (3) automatically with mailpieces from a stack of mailpieces, the manual feed station (9) being adapted to receive mailpieces inserted individually and to place them in the conveyor, said postal sorting machine being characterized in that the manual feed station (9) comprises a protective cover (25) forming a sort of tunnel over the conveyor, and an insertion slot (26) provided in the protective cover and through which a mailpiece can be inserted into the tunnel, said slot being in vertical alignment with a mailpiece receiving and handling space (34) for receiving and handling a mailpiece in the conveyor, which space is funnel-shaped.

2. A sorting machine according to claim 1, wherein said funnel-shaped space has a bottom defined by a horizontal bed onto which the mailpiece inserted into the slot falls on edge, and sides defined by two conveying surfaces that extend relative to each other so as to converge in the conveying direction.

3. A sorting machine according to claim 2, wherein the conveying surfaces of said mailpiece receiving and handling space that forms a sort of funnel are constituted by two opposite belts (32, 33) mounted on pulleys, one of the two belts being engaged, in the zone of convergence with the other belt, over a pulley having an axle that is mounted to move relative to the bed and that is inclined relative to the vertical.

4. A sorting machine according to claim 1, wherein the manual feed station (9) is interposed between the unstacker device (8) and an image acquisition device (4) serving to read postal addresses.

5. A sorting machine according to claim 1, wherein said manual feed station (9) is part of a mailpiece-tilting station for tilting each mailpiece from an on-edge vertical position to an inclined position in which it is inclined relative to the vertical.

* * * * *